US011685074B2

(12) United States Patent
Osawa et al.

(10) Patent No.: US 11,685,074 B2
(45) Date of Patent: Jun. 27, 2023

(54) HAND-HELD WORKING MACHINE

(71) Applicant: YAMABIKO CORPORATION, Tokyo (JP)

(72) Inventors: Hisato Osawa, Tokyo (JP); Takeshi Maeno, Tokyo (JP); Atsushi Nishimura, Tokyo (JP)

(73) Assignee: YAMABIKO CORPORATION, Tokyo (JP)

( * ) Notice: Subject to any disclaimer, the term of this patent is extended or adjusted under 35 U.S.C. 154(b) by 217 days.

(21) Appl. No.: 17/105,611

(22) Filed: Nov. 26, 2020

(65) Prior Publication Data

US 2021/0154880 A1 May 27, 2021

(30) Foreign Application Priority Data

Nov. 27, 2019 (JP) ..... JP2019-214312

(51) Int. Cl.
*B27B 17/00* (2006.01)
*B25F 5/02* (2006.01)

(52) U.S. Cl.
CPC ..... *B27B 17/0008* (2013.01); *B25F 5/02* (2013.01)

(58) Field of Classification Search
CPC ..... B27B 17/0008; B25F 5/02
USPC ..... 30/296.1, 298.4, 298
See application file for complete search history.

(56) References Cited

U.S. PATENT DOCUMENTS 5,046,566 A * 9/1991 Dorner ..... F16F 1/3732 30/381
5,272,813 A 12/1993 Wolf et al.
5,960,549 A * 10/1999 Hoppner ..... B27B 17/0008 30/381
5,992,025 A * 11/1999 Fricke ..... B25F 5/02 30/298.4
2008/0163464 A1* 7/2008 Baumann ..... A45F 5/02 24/3.12
2011/0289786 A1* 12/2011 Bijsterveldt ..... B25F 5/02 30/514
2012/0067931 A1* 3/2012 Yanosick ..... A45C 13/30 224/257

FOREIGN PATENT DOCUMENTS

JP 2016199005 A 12/2016

* cited by examiner

*Primary Examiner* — Phong H Nguyen
(74) *Attorney, Agent, or Firm* — Hauptman Ham, LLP

(57) ABSTRACT

Provided is a hand-held working machine, including a connection receiving portion configured to connect an anchoring rope, which is configured to couple a machine body and an operator to each other, to the machine body. The connection receiving portion includes: an other-function portion provided to the machine body as a portion having other function or use; and a protrusion configured to retain the anchoring rope at a predetermined position of the other-function portion.

9 Claims, 3 Drawing Sheets

HAND-HELD WORKING MACHINE

CROSS REFERENCE TO RELATED APPLICATIONS

This application is based upon and claims the benefit of priority under from the prior Japanese Patent Application No. 2019-214312, filed on Nov. 27, 2019, the entire contents of which is hereby incorporated by references.

BACKGROUND OF THE INVENTION

1. Field of the Invention

This disclosure relates to a hand-held working machine, and more specifically, to a hand-held working machine that is suitable for work at a high place.

2. Description of the Related Art

Examples of work at a high place with use of a hand-held working machine include trimming of a tree. The trimming may be performed with use of a small-sized chain saw that is called "top-handle saw" as an example of the hand-held working machine. In this case, an operator climbs up a tree while holding the chain saw and performs trimming on the tree while holding the chain saw by hands.

When an operator climbs up or down a tree, or changes a working location on the tree, it is required that the operator can freely use both hands. Therefore, it is preferred that the chain saw be held on the operator's body and supported in a suspended manner as needed. In view of this, there has been proposed a chain saw including a hook which is engageable with and removable from, for example, a carabiner of a belt worn by an operator (U.S. Pat. No. 5,272,813 and JP 2016-199005 A).

It is required that an operator shift the chain saw, which is supported on the operator's body in a suspended manner, from the body to hands on the tree. At the time of shifting the chain saw, there is a fear in that the operator may accidentally drop the chain saw after removing the hook. In view of this, in order to prevent the chain saw from significantly falling even in such a case, it is preferred that, during work, the chain saw and the operator be always anchored to each other with use of an anchoring rope having such a suitable length that the anchoring rope does not hinder the trimming work. In such a manner, even when the operator accidentally drops the chain saw at a high place, the chain saw can be prevented from falling.

However, the related-art chain saw does not include a connection receiving portion that is suitable for receiving the anchoring rope to be connected. The anchoring rope is to be used for work at a certain location, such as work at a high place. Therefore, it is preferred that arrangement of the connection receiving portion on the chain saw be made in a mode which can be achieved with a simple configuration and at low cost. Further, it is preferred that, for example, the following suitable arrangement requirements for arrangement of the connection receiving portion on the chain saw be also satisfied. That is, the anchoring rope does not hinder she work. The anchoring rope can easily be mounted and removed. The connection receiving portion is located at a position at which the anchoring rope can easily be mounted and removed. An operator is less liable to be harmed by a blade of the chain saw when the chain saw is supported in a suspended manner with the anchoring rope.

SUMMARY OF THE INVENTION

This disclosure has been made in view of the circumstances described above, and has an object to provide a hand-held working machine including a connection receiving portion for an anchoring rope, which is arranged in a mode that satisfies at least one of she arrangement requirements described above.

In order to solve the above-mentioned problem, there is provided a hand-held working machine, including a connection receiving portion configured to connect an anchoring rope, which is configured to couple a machine body and an operator to each other, to the machine body, wherein the connection receiving portion includes: an other-function portion provided to the machine body as a portion having other function or use; and a protrusion configured to retain the anchoring rope at a predetermined position of the other-function portion.

According to this disclosure, the other-function portion, which is provided to the machine body as a portion having other function or use, serves as the connection receiving portion. Therefore, the hand-held working machine is simpler in configuration and more advantageous in terms of cost as compared to a case in which a single purpose connection receiving portion is additionally provided. Further, the anchoring rope is retained by the protrusion at a predetermined position of the other-function portion. Therefore, unnecessary movement of the anchoring rope is prevented. Consequently, the anchoring rope does not hinder the work.

According to at least one embodiment of this disclosure, a work tool may be arranged at a front portion of the machine body, wherein the work tool may include a blade, and the protrusion may be located on a rear side with respect to a center of front-rear weight balance of the entire hand-held working machine. In this case, under a state in which the hand-held working machine is suspended by the anchoring rope, the work tool including the blade is directed downward. Therefore, an operator is less liable to be harmed.

According to at least one embodiment of this disclosure, the other-function portion is a handle configured to allow an operator to hold the machine body, and the protrusion may be arranged at such a position and/or with such a shape that the protrusion is prevented from being obstructive with respect to an operator's hand gripping the handle. In this case, a part of the handle is used as the connection receiving portion. The handle has such a diameter that an operator can grip the handle. Therefore, the anchoring rope can easily be mounted and removed, and is strong. Further, the protrusion suppresses movement of an operator's hand gripping the handle. Therefore, during work, abutment of an operator's hand against the anchoring rope may be prevented. Further, movement of the anchoring rope toward an operator's hand may also be prevented.

According to at least one embodiment of this disclosure, the other-function portion may be closed. In this case, the other-function portion is closed, and hence the anchoring rope is prevented from unexpectedly coming off. The state in which the other-function portion is closed includes a case in which the other-function portion has a loop shape or a case in which the other-function portion is integrated with the machine body to form a loop shape.

According to at least one embodiment of this disclosure, the protrusion may be formed toward an inner side of the machine body. In this case, an increase in the size of the working machine is prevented, and the protrusion does not hinder the work.

According to at least one embodiment of this disclosure, the protrusion may be formed to be open to an inside of the other-function portion. In this case, through movement of the anchoring rope with use of the opening, the operation of mounting or removing the anchoring rope to or from the connection receiving portion can easily be performed. That is, at the time of mounting the anchoring rope to the connection receiving portion, the anchoring rope is first connected to the other-function portion at a position to which the anchoring rope can easily be connected. Then, the anchoring rope is moved to the connection receiving portion by allowing the anchoring rope to pass through the opening and move over the protrusion. In such a manner, the operation of mounting the anchoring rope to the connection receiving portion can easily be performed. Further, at the time of removing the anchoring rope from the connection receiving portion, a working process that is reverse to the working process described above is performed. Accordingly, the operation of removing the anchoring rope can easily be performed.

According to at least one embodiment of this disclosure, the other-function portion may be any one of:

- a large-diameter ring-shaped portion provided to the machine body;
- a handle provided to the machine body;
- a side handle provided at a side portion of the machine body;
- a side handle extending rearward along a side surface of the machine body; and
- a hook configured to couple the machine body to an operator.

DETAILED DESCRIPTION OF THE PREFERRED EMBODIMENT

Figure 1:
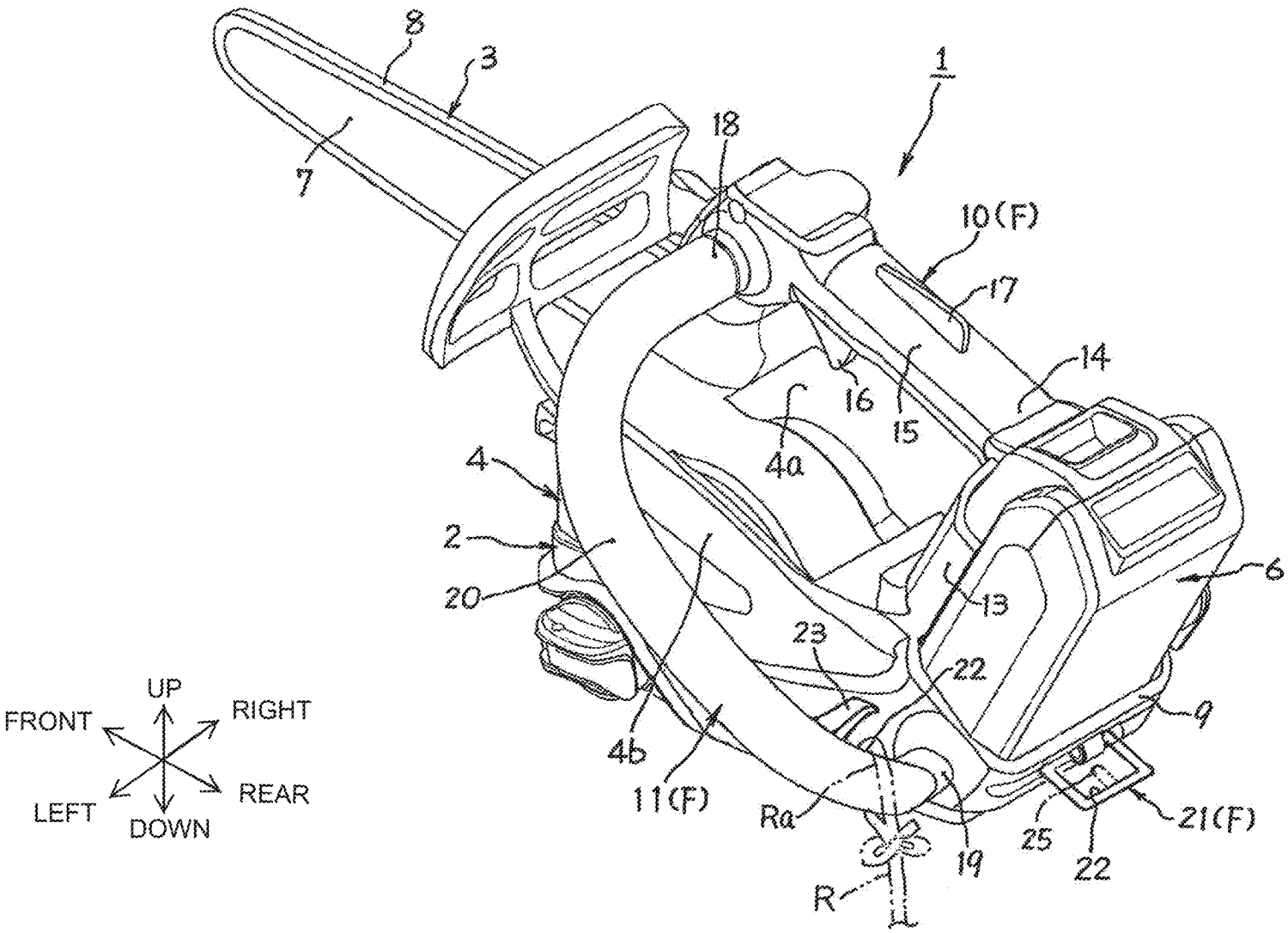
FIG. 1 is a perspective view for illustrating a chain saw which is an example of a hand-held working machine according to one embodiment of this disclosure.

Now, with reference to the accompanying drawings, an embodiment of this disclosure is described. In the accompanying drawings, a small-sized chain saw that is called "top-handle saw" is illustrated as a specific example of a hand-held working machine according to one embodiment of this disclosure. This chain saw can be handled by an operator by one hand, and hence is suitable for use in work of climbing up a tree and performing trimming. In the specification, directions of front, rear, right, left, up, and down are specified based on indications of directions given in the drawings.

Figure 2:
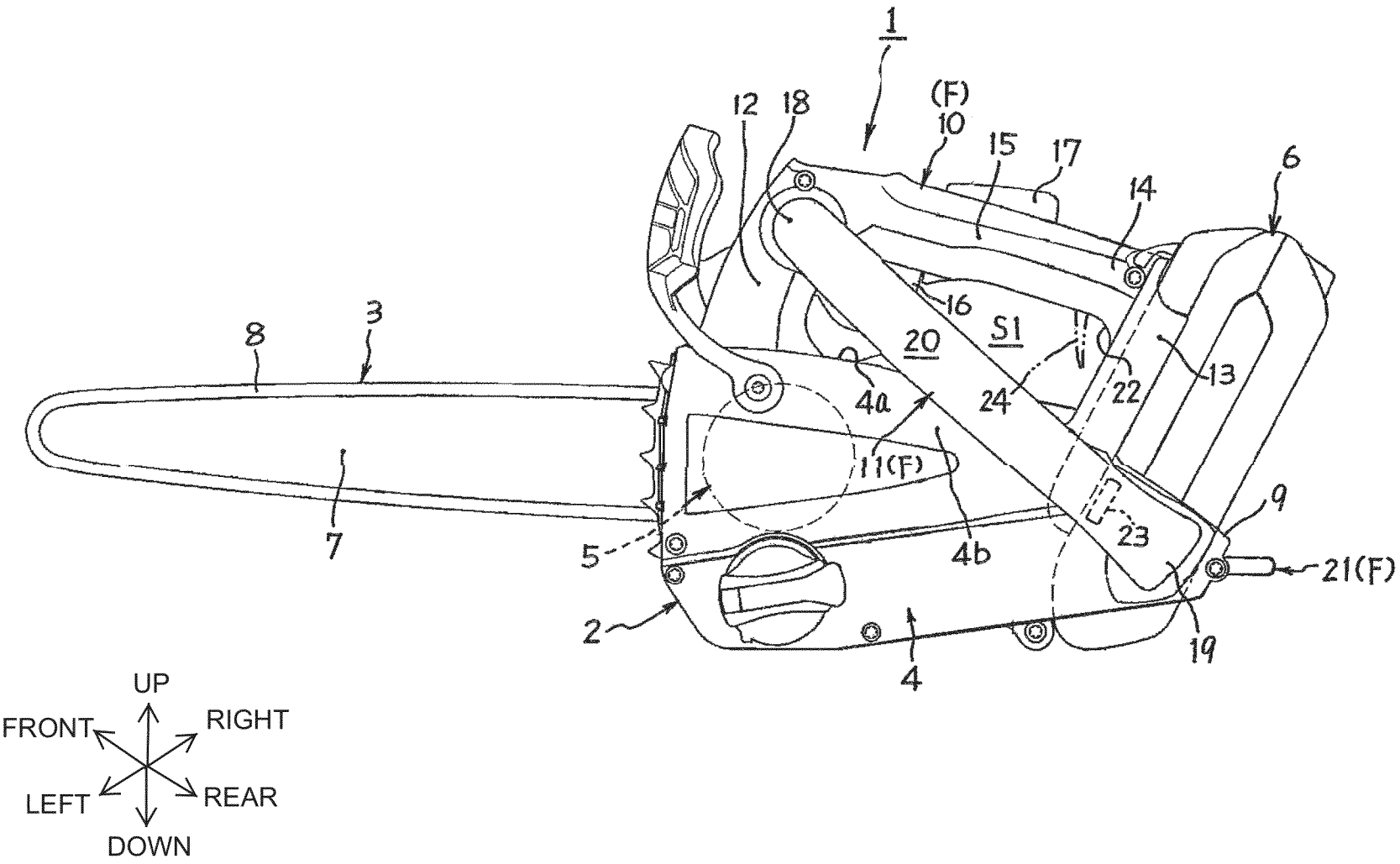
FIG. 2 is a left side view for illustrating the chain saw of FIG. 1.

With reference to FIG. 1 and FIG. 2, a chain saw 1 according to one embodiment of this disclosure includes a machine body 2 and a work tool 3. The work tool 3 is located at a front portion of the machine body 2. The machine body 2 includes a main-body case 4. A motor 5 (illustrated only in FIG. 2) and a battery 6 are mounted to the main-body case 4. The motor 5 serves as a prime mover. The battery 6 is removably mounted to the main-body case 4. The work tool 3 is driven through supply of power from the battery 6 to the motor 5. A small-size and small-weight internal combustion engine may be mounted in place of the motor 5 as a prime mover. In this case, a fuel tank is mounted in place of the battery 6.

In the illustrated example, the work tool 3 is a chain-type cutter. The chain-type cutter 3 includes a guide bar 7 and a saw chain 8. The guide bar 7 extends forward from the front right side of the machine body 2. The saw chain 6 has a loop shape and is configured to slide along an outer periphery of the guide bar 7. The saw chain 8 includes a blade. The saw chain 8 is driven by the motor 5 to rotate along the outer periphery of the guide bar 7 to cut an object to be cut, such as a trunk or a branch of a tree.

The main-body case 4 is a case made of a resin. A battery case 9 is located at a rear portion of the main-body case 4 and is formed integrally with the main-body case 4. The battery case 9 is open upward, and is configured to removably hold the battery 6.

A top handle 10 is formed integrally with the main-body case 4, and is located at an upper portion of the main-body case 4. Further, a side handle 11 is mounted to a left side surface of the main-body case 4. An operator can perform work while gripping the top handle 10 and the side handle 11 by hands. Further, in some cases, the operator may perform work while gripping only the top handle 10.

As illustrated in FIG. 2, the top handle 10 is formed in such a manner as to be continuous with an upper surface 4*a* of the main-body case 4, and extends in a front-and-rear direction above the main-body case 4. A front portion 12 of the top handle 10 is bent downward, and is continuous with the upper surface 4*a* at the front portion of the main-body case 4. A rear portion 14 of the top handle 10 is coupled to an upper end of a battery holder 13 forming a front portion of the battery case 9.

An upper grip portion 15 extends between the front portion 12 and the rear portion 14 of the top handle 10. The upper grip portion 15 is a portion to be gripped by an operator when the operator holds the chain saw 1. The upper grip portion 15 is slightly inclined downward from the front portion 12 toward the rear portion 14 of the top handle 10. A space S1 for receiving an operator's hand is defined between the upper grip portion 15 and the upper surface 4*a* of the main-body case 4.

Further, a trigger lever 16 serving as operating means for increasing and decreasing the rotation number of the motor 5 is arranged on a lower surface of the front portion of the upper grip portion 15. An operator can operate the trigger lever 16 under a state in which the operator grips the upper grip portion 15. A safety lever 17 is arranged on an upper surface of the upper grip portion 15 so as to freely project and retract. When the operator grips the upper grip portion 15, the safety lever 17 is pushed by a palm to retract into the upper grip portion 15. The safety lever 17 and the trigger lever 16 are operatively coupled to each other in the upper grip portion 15 so that the trigger lever 16 can be operated only after the retraction of the safety lever 17.

Referring to FIG. 2, the side handle 11 extends in the front-and-rear direction from a front portion to a rear portion of a left side surface 4*b* of the main body case 1. The side handle 11 may be made of a resin or may be formed by bending a metal pipe having a small weight. A front end 18 of the side handle 11 is fixed to an upper portion of the front portion 12 of the top handle 10. A rear end 19 of the side handle 11 is fixed to a left side wall of the battery case 9. The rear end 19 of the side handle 11 is located below the front end 18. The side handle 11 extends in an inclined manner from the upper portion of the front portion of the main-body case 4 toward the lower portion of the rear portion of the main-body case 4.

Figure 3:
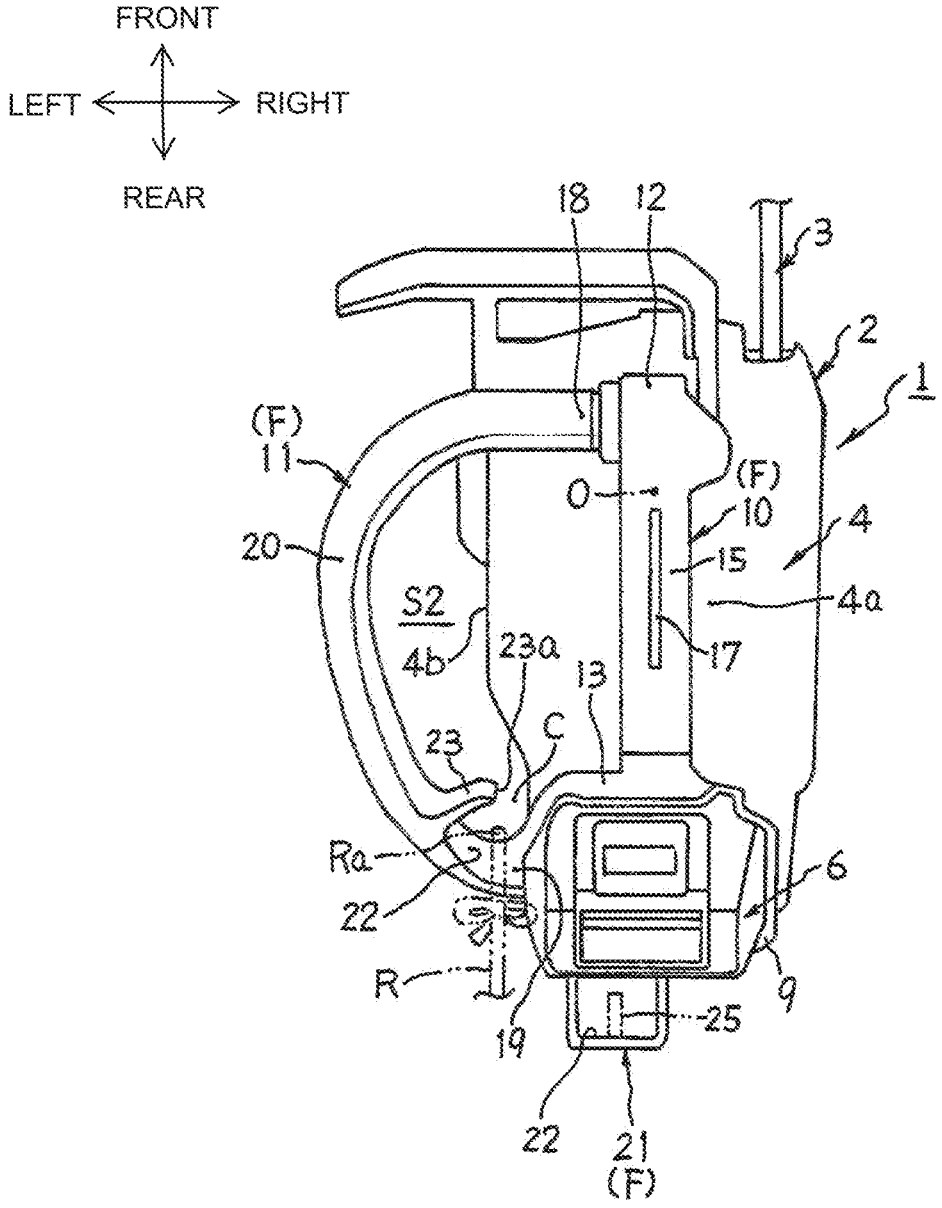
FIG. 3 is a top view for illustrating a machine body portion of the chain saw of FIG. 1.

As illustrated in FIG. 1 and FIG. 3, apart of the side handle 11 between the front end 18 and the rear end 19 is curved in such a manner as to expand outward with respect the left side surface 4*b* of the main-body case 4. Thus, the side handle 11 is integrated with the main-body case 4 to form a large-diameter ring-shaped portion.

A side grip portion 20 extends between the front end 18 and the rear end 19 of the side handle 11. The side grip portion 20 is a portion to be gripped by an operator when the operator holds the chain saw 1, and is located on a left side of the main-body case 4. A large space S2 for receiving a user's hand is defined between the side grip portion 20 and the left side surface 4*b* of the main-body case 4 (see FIG. 3). As illustrated in FIG. 2, in a left side view of the main-body case 4, the side grip portion 20 is inclined in such a manner as to gradually become lower as extending from the front side toward the rear side.

As illustrated in FIG. 1 to FIG. 3, a hook 21 is arranged at a rear end of the main-body case 4. The hook 21 is freely engageable with and removable from a fixing tool such as a carabiner of a belt worn by an operator. An operator can use the hook 21 to couple the machine body 2 of the chain saw 1 to the operator's body as needed. For example, in the case of performing trimming of a tree with use of the chain saw 1, when the operator climbs up or down a tree or changes a working location on the tree, the operator can use the hook 21 to couple the chain saw 1 to the operator and support the chain saw 1 in such a manner that the chain saw 1 is suspended from the operator's body with the work tool 3 being directed downward. In such a manner, an operator can freely use both hands. Therefore, such a configuration is preferred. When the hook 21 has such a configuration that the hook 21 can be accommodated along the main-body case 4 at the time of not using the hook 21, breakage of the hook 21 at the time of not using the hook 21 can be prevented, and the hook 21 does not hinder the work. Therefore, such a configuration is favorable. The hook 21 may be in a mode in which the hook 21 is integrated with the main-body case 4 to form a loop shape or a mode in which the hook 21 has a loop shape.

As illustrated in FIG. 1 and FIG. 3, the chain saw 1 includes, in addition to the hook 21, a connection receiving portion 22 for an anchoring rope R. The anchoring rope R is to be used for work at a high place, such as trimming of a tree, and is configured to couple the chain saw 1 and an operator's body to prevent the chain saw 1 from failing. For example, the anchoring rope R is connected to the chain saw 1 before an operator climbs up a tree and is kept being connected until the operator comes down to the ground after the trimming work.

Specifically, at the time of starting the trimming work on a tree, it is required that an operator shift the chain saw 1, which is suspended on the body with the hook 21, from the body to hands on the tree. At the time of shifting the chain saw 1, there is a fear in that the operator may accidentally drop the chain saw 1 after removing the hook 21. In view of this, in order to prevent the chain saw 1 from significantly falling even in such a case, before climbing up the tree, the chain saw 1 is connected to the operator's body with use of the anchoring rope R having such a suitable length that the anchoring rope R does not hinder the trimming work. In such a manner, even when the operator accidentally drops the chain saw 1 at a high place, the chain saw 1 can be prevented from falling.

The anchoring rope R can be used not only for the work at a high place such as trimming but also for work on an inclined ground. In this case, a chain saw that is temporarily placed on the inclined ground during logging work can be prevented from rolling down.

According to the one embodiment, the connection receiving portion 22 for the anchoring rope R includes an other-function portion F and a protrusion 23. The other-function portion F is provided to the main body 2 of the chain saw 1 as a portion having other function or use. The protrusion 23 is configured to retain the anchoring rope R at a predetermined position of the other-function portion F.

With such a configuration, the other-function portion F serves as the connection receiving portion 22. Therefore, the chain saw 1 is simpler in configuration and more advantageous in terms of cost as compared to a case in which a single-purpose connection receiving portion is additionally provided. Further, the anchoring rope R is retained by the protrusion 23 at a predetermined position of the other-function portion F. Therefore, unnecessary movement of the anchoring rope is prevented. Consequently, the anchoring rope R does not hinder the work.

As a preferred example of the other-function portion F, in the illustrated example, there is given the mode using the side handle 11. That is, the protrusion 23 is provided to the side handle 11, and the side handle 11 and the protrusion 23 form the connection receiving portion 22. The protrusion 23 is arranged at such a position and/or with such a shape that the protrusion 23 is prevented from being obstructive with respect to an operator's hand gripping the side handle 11. The protrusion 23 retains the anchoring rope R at a predetermined position of the side handle 11 at which the anchoring rope R does not hinder the work. The protrusion 23 may be formed integrally with the side handle 11 at the time of manufacture of the side handle 11 or may be added to the side handle 11 later.

In this case, a part of the side handle 11 is used as the connection receiving portion 22. Accordingly, the following actions and effects can be achieved. The side handle 11 has such a diameter that an operator can grip the side handle 11. Therefore, the anchoring rope R can easily be mounted and removed, and is strong. Further, the protrusion 23 suppresses movement of an operator's hand gripping the side handle 11. Therefore, during work, abutment of an operator's hand against the anchoring rope R is prevented. Further, movement of the anchoring rope R toward an operator's hand is also prevented. Further, the side handle 11 is formed integrally with the main-body case 4 to form a closed loop shape, and hence the anchoring rope R is less liable to unexpectedly come off.

A preferred arrangement mode of the protrusion 23 on the side handle 11 is described. As illustrated in FIG. 2 and FIG. 3, the protrusion 23 is formed at a position close to the rear end 19 of the side handle 11 and on an inner side of the side handle 11 (main-body case 4 side) and extends in a direction of approaching the main-body case 4. It is preferred that the protrusion 23 be formed so as to be open toward an inside of the side handle 11. That is, it is preferred that a mode in which a clearance C (see FIG. 3) is defined between a distal end 23*a* of the protrusion 23 and the main-body case 4 be adopted.

It is preferred that the protrusion 23 be arranged on a rear side with respect to a center O (see FIG. 3) of front-rear weight balance of the entire chain saw. With such arrangement, under the state in which the chain saw 1 is suspended by the anchoring rope R, the chain-type cutter 3 including the blade is directed downward. Therefore, an operator is less liable to be harmed. In the example illustrated in FIG. 2 and FIG. 3, the protrusion 23 is formed near the rear end 19 of the side handle 11 that extends to a rear portion of the machine body 2. Therefore, the protrusion 23 is located at a rear portion of the entire chain saw, and the most preferred mode is achieved. The protrusion 23 is prevented from being obstructive with respect to an operator's hand gripping the side handle 11.

As illustrated in FIG. 3, when the protrusion 23 is formed toward an inner side of the machine body 3, an increase in the size of the chain saw 1 is prevented, and the protrusion 23 does not hinder the work.

As illustrated in FIG. 3, when the protrusion 23 is formed to be open to the inside of the side handle 11, that is, when the clearance C is defined between the distal end 23*a* of the protrusion 23 and the main-body case 4, through movement of the anchoring rope R with use of the clearance C, the operation of mounting or removing the anchoring rope R to or from the connection receiving portion 22 can easily be performed. That is, at the time of mounting the anchoring rope R to the connection receiving portion 22, the anchoring rope R is first formed into a large loop shape and connected to the side handle 11 at a position to which the anchoring rope R can easily be connected (for example, an upper portion of the side grip portion 20, which is apart from the main-body case 4 by a large distance). Then, a loop-shaped connection portion Ra of the anchoring rope R is moved to the connection receiving portion 22 by allowing the connection portion Ra to pass through the clearance C and move over the protrusion 23. Finally, the loop-shaped connection portion Ra of the anchoring rope R is tightened. In such a manner, the operation of mounting the anchoring rope R to the connection receiving portion 22 can easily be performed. Further, at the time of removing the anchoring rope R from the connection receiving portion 22, a working process that is reverse to the working process described above is performed. Accordingly, the operation of removing the anchoring rope R can easily be performed.

As illustrated in FIG. 3, when the distal end 23*a* of the protrusion 23 is curved in a direction of reducing an opening width (width of the clearance C) of an inlet of the connection receiving portion 22, the operation of allowing the loop-shaped connection portion Ra of the anchoring rope R to move over the protrusion 23 to move to the connection receiving portion 22 can be smoothly performed, and the connection portion Ra of the anchoring rope R is less liable to move in the opposite direction from the connection receiving portion 22. Thus, such configuration is preferred.

Moreover, as illustrated in FIG. 3, when the protrusion 23 is formed in the vicinity of the battery 6, and the connection portion Ra of the anchoring rope R is arranged in the vicinity of the battery 6 that is relatively heavy, the weight balance of the hand-held working machine in the state of being suspended is improved. Therefore, the working machine is more likely to be stabilized.

Another example of the other-function portion F may be the top handle 10. Also in this case, as a matter of course, it is preferred that the protrusion be arranged at a position at which the protrusion 23 is prevented from being obstructive with respect to an operator's hand gripping the top handle 10 and on the rear side with respect to the center O of the front-rear weight balance of the entire chain saw. As one example, illustration is given of a mode in which, as indicated by an imaginary line in FIG. 2, a protrusion 24 is formed so as to extend downward from a lower surface of the rear portion 14 of the top handle 10. Also in the case of using the top handle 10 as the other-function portion F, the actions and effects which are the same as those of the case of using the side handle 11 can be achieved.

A still another example of the other-function portion F may be the hook 21 arranged at the rear end of the main-body case 4. The hook 21 originally is a component for supporting the chain saw 1 in a suspended manner with the work tool 3 being directed downward. Therefore, the hook 21 is suitable as the connection receiving portion for the anchoring rope R in terms of strength and balance given at the time of suspension. As one example, illustration is given of a mode in which, as indicated by an imaginary line in FIG. 1 and FIG. 3, a protrusion 25 is formed so as to extend from a center portion of the hook 21 in the right-and-left direction toward the main-body case 4 side. In this case, a rear portion of an internal space of the hook 21 is divided into right and left sections by the protrusion 25. In this case, the internal space on one side can be used as the connection receiving portion 22 for the anchoring rope R. Also in the case of using the hook 21 as the other-function portion F, the actions and effects which are the same as those described above can achieved.

The embodiments of this disclosure have been described in detail with reference to the drawings. However, a specific configuration is not limited to those of the embodiments described above. For example, changes in design without departing from the scope of this disclosure are encompassed in this disclosure. Further, technologies in the above-mentioned embodiments described above may be used in combination as long as there is no particular contradiction or problem in, for example, purpose and configuration.

What is claimed is:

1. A hand-held working machine, comprising:

a machine body; and a connection receiving portion configured to connect an anchoring rope, which is configured to couple the machine body and an operator to each other, to the machine body, wherein the connection receiving portion includes:

a handle provided to the machine body; and a protrusion configured to retain the anchoring rope at a predetermined position of the handle, the protrusion protrudes from the handle toward the machine body, and the protrusion includes a distal end spaced away from an external surface of the machine body by a clearance to allow mounting or removing the anchoring rope to or from the handle.

2. The hand-held working machine according to claim 1, further comprising a work tool arranged at a front portion of the machine body, wherein the work tool includes a blade, and the connection receiving portion further includes a further protrusion located on a rear side with respect to a center of front-rear weight balance of an entirety of the hand-held working machine.

3. The hand-held working machine according to claim 1, wherein the handle is configured to allow the operator to hold the machine body, and wherein the protrusion is arranged at such a position and/or with such a shape that the protrusion is prevented from being obstructive with respect to an operator's hand gripping the handle.

4. The hand-held working machine according to claim 3, wherein the handle and the machine body define a closed shape.

5. The hand-held working machine according to claim 4, wherein the protrusion protrudes from the handle toward an inner side of the machine body.

6. The hand-held working machine according to claim 1, wherein the handle and the machine body define a closed shape.

7. The hand-held working machine according to claim 1, wherein the protrusion protrudes from the handle toward an inner side of the machine body.

8. The hand-held working machine according to claim 1, wherein the handle is a side handle provided at a side portion of the machine body; or a side handle extending rearward along a side surface of the machine body.

9. The hand-held working machine according to claim 1, further comprising a hook arranged at a rear end of the machine body and configured to retain the anchoring rope at a predetermined position of the hook, and a further protrusion protrudes from a center portion of the hook toward the machine body.

* * * * *